United States Patent [19]

Isayama et al.

[11] 4,299,188

[45] Nov. 10, 1981

[54] COATING APPARATUS

[75] Inventors: Shogo Isayama; Nobumitsu Takehara, both of, Kanagawa, Japan

[73] Assignee: Fuji Photo Film Co., Ltd., Minami-ashigara, Japan

[21] Appl. No.: 101,382

[22] Filed: Dec. 7, 1979

[30] Foreign Application Priority Data

Dec. 25, 1978 [JP] Japan ..... 53-165011

[51] Int. Cl.[3] ..... B05C 5/02

[52] U.S. Cl. ..... 118/412; 118/419

[58] Field of Search ..... 118/412, 407, 411, 415, 118/419

[56] References Cited

U.S. PATENT DOCUMENTS

| | | | |
|---|---|---|---|
| 2,761,791 | 9/1956 | Russell | 118/410 X |
| 3,928,678 | 12/1975 | Jackson | 118/411 X |
| 3,928,679 | 12/1975 | Jackson et al. | 118/411 X |
| 4,143,190 | 3/1979 | Choinski | 118/412 X |

*Primary Examiner*—John P. McIntosh

*Attorney, Agent, or Firm*—Sughrue, Mion, Zinn, Macpeak & Seas

[57] ABSTRACT

A slide-type bead coating apparatus in which a semi-circular groove is formed in the groove surface adjacent a moving web. The speed of the coating liquids is rapidly increased as the liquid flows drop abruptly along the falling part of the groove after which the liquids are smoothly delivered from the rising part of the groove. The maximum possible coating speed is significantly increased especially for low liquid flow rates.

6 Claims, 4 Drawing Figures

COATING APPARATUS

BACKGROUND OF THE INVENTION

The present invention relates to an apparatus for coating a conveyed long, flexible support (hereinafter referred to as "a web" when applicable) with a liquid-type coating compound.

An example of a coating apparatus which has been extensively employed to coat a liquid-type coating compound (hereinafter referred to as "a coating liquid" when applicable) onto a web is multi-layer slide bead coating apparatus as proposed in U.S. Pat. No. 2,761,791 issued to Russell et al. In this conventional coating apparatus, a plurality of coating liquids flow down the slide surface striking against a conveyed web at the lower end of the slide surface so as to form a bead. By utilizing the bead, the coating liquids are applied to the web. Accordingly, in a coating apparatus of this type, it is essential to maintain the bead stable in order to successfully apply the coating liquids to the web. However, as the coating speed is increased, it tends to become difficult to maintain the bead stable.

In order to overcome this difficulty, an improved coating apparatus was proposed by Jackson in U.S. Pat. No. 3,928,678. This coating apparatus can eliminate the instability of the bead which results as the coating speed is increased. In the conventional coating apparatus, a lip-shaped member is provided at the lower edge of the slide surface for decreasing the speed of the layer of coating liquid flowing down the slide surface in order to increase the thickness of the liquid flow and to thereby to make the bead stable. With such a coating apparatus, particle effect in the coating liquid (appearance of stripes due to irregular coating) is observed which may be attributed to the increase of the thickness of the layer of coating liquid. However, if it is desired to increase the coating speed with the bead maintained stable, this coating apparatus is not suitable. That is, the permissible increase in coating speed is not more than about 10%. In addition, the increase is permitted only in the case where the flow rate of coating liquid is relatively high. If the flow rate of coating liquid is relatively low, the permissible increase is sometimes lower than that of the coating apparatus proposed by Russell et al U.S. Pat. No. 2,761,791.

Accordingly, an object of this invention is to provide a coating apparatus in which all of the above-described difficulties accompanying a conventional coating apparatus have been eliminated and the coating speed can be greatly increased especially in the case where the flow rate of coating liquid is a relatively low rate.

SUMMARY OF THE INVENTION

The foregoing object and other objects of the invention have been achieved by the provision of a slide bead coating apparatus having a slide surface in which, according to the invention, is formed a groove having falling part which is bent abruptly downwardly at the lower edge of the slide surface and an rising part extending smoothly upwardly from the falling part wherein the speed of a layer of coating liquid flowing down the slide surface is increased by the falling part and is smoothly delivered through the rising part extending from the falling part of a web to be coated with the layer of coating liquid.

DESCRIPTION OF THE PREFERRED EMBODIMENTS

Figure 1:
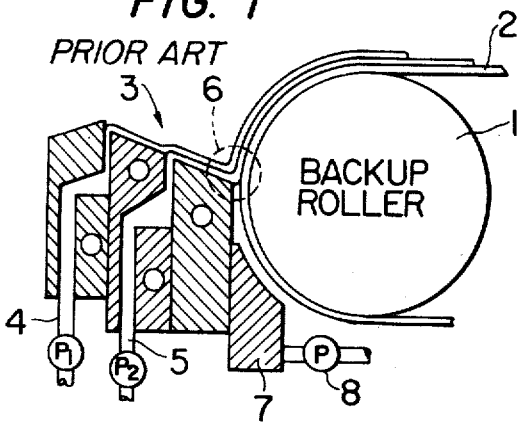
FIG. 1 PRIOR ART
FIG. 1 is a sectional view of a conventional coating apparatus.

The invention will be described with reference to the accompanying drawings. FIG. 1 is a side view of the conventional coating device which has been proposed in the Russell et al patent discussed above. In the device, a web 2 is conveyed by being placed around a coating back-up roller 1 and a coating head 3 is disposed adjacent to the web 2 thus conveyed. Coating liquids 4 and 5 are supplied to the coating head 3 by measuring pumps P1 and P2, respectively. The coating liquids thus supplied are dispensed from slitshaped openings formed in the upper portion of the coating head 3 and flow in the form of two layers on the slide surface. In the case of FIG. 1, the two layers of coating liquids in contact with each other flow down the slide surface without being mixed to a bead forming section 6. A chamber 7 is connected to a vacuum pump 8 which thus serves as bead stabilizing back-pressure supplying means.

Figure 2:
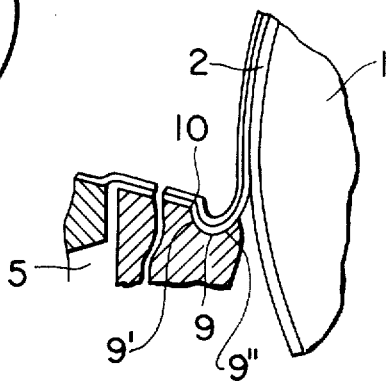
FIG. 2 is a sectional view showing the essential components of a preferred embodiment of a coating apparatus according to the invention.

FIG. 2 is a side view showing the essential components of a coating device according to a preferred embodiment of the invention. The coating device of the invention is different from the conventional one described above in that a groove 9 having a semi-circular cross-section with a radius of 5 mm is formed in the lower edge portion of the slide surface, the groove 9 extending over the entire width of the slide surface. The center of the groove 9 lies on the extension of the slide surface. The line 10 of intersection of the groove and the slide surface form a smooth connection surface having a radius of 0.5 mm.

The coating liquids 4 and 5 flow down the slide surface and enter the groove 9 passing over the intersection line 10 formed by the lower edge of the slide surface. Immediately, when the coating liquids enter the groove 9, they first meet the falling part (wall) 9' of the groove 9. As a result, the speed of movement of the coating liquids is increased because the falling part is inclined abruptly downwardly at the intersection line. Thereafter, the coating liquids move along the rising part 9'' of the groove 9 which is smoothly continuous with the falling part so that finally the coating liquids are delivered to the web which is being conveyed. During the period of time which elapses from the time instant that the coating liquids flow along the falling part of the groove until they reach the web, the coating liquids substantially continuously and relatively gradually extend into thinner layers which are coated onto the web.

Figure 3:
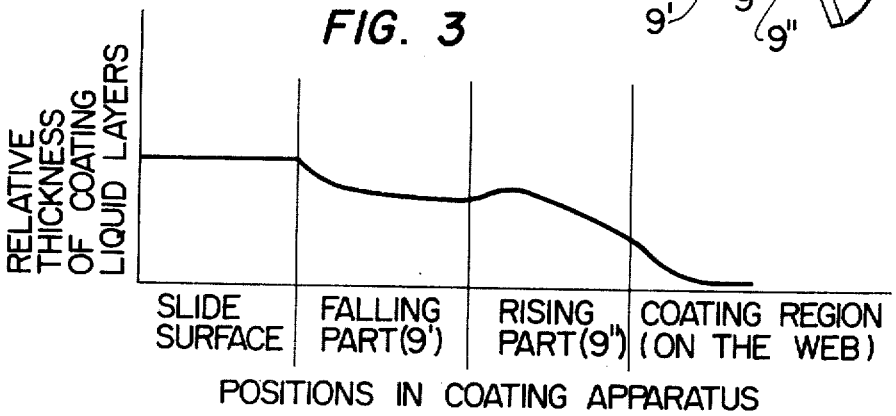
FIG. 3 and FIG. 4 are graphical representations indicating the variations in thickness of layers of coating liquids.

The relative variations in thickness of the layers of coating liquids are as indicated in FIG. 3. As is apparent from FIG. 3, the layers of coating liquids are greatly thinned as they flow down the falling part 9' of the groove 9. However, the thickness changes less when they move upwardly along the rising part 9'' of the groove from the falling part. Finally, the two layers are thinned considerably when they are coated onto the web after passing the rising part of the groove. As the layers of coating liquids are thinned over a relatively long distance, they are thinned quite gradually.

Figure 4:
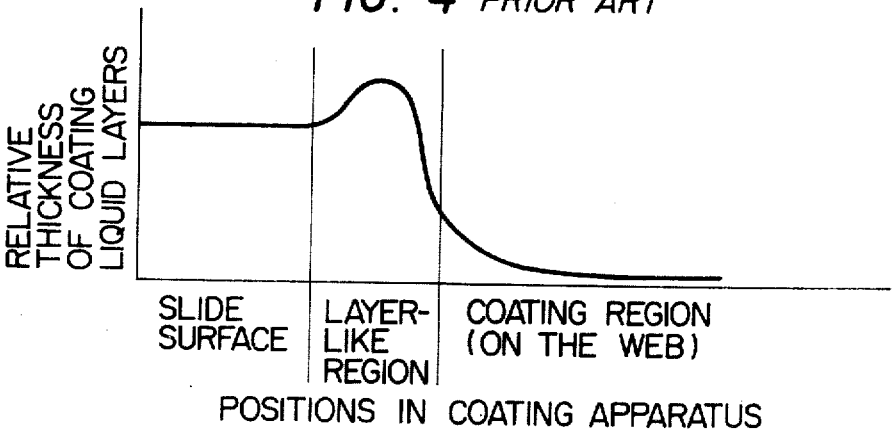
FIG. 4 PRIOR ART

FIG. 4 indicates the relative variation in thickness of layers of coating liquids in a coating apparatus such as disclosed in referenced U.S. Pat. No. 3,928,678. It can be readily understood from a comparison of FIGS. 3 and 4 that thinning of the layers of coating liquids in the conventional apparatus is carried out relatively abruptly in a short period of time as compared to the apparatus according to the invention.

If the section of the groove 9 is made semi-circular as described above, the groove can be easily formed. However, this particular shape is not limitative. That is, the section of the groove 9 may be a quadratic curve or another such curve so long as it forms the falling part of the groove and the rising part smoothly extending therefrom as described above. In the case where the section of the groove is semi-circular, the radius may be 3 to 15 mm, preferably 4 to 12 mm, and more preferably 5 to 10 mm. In the case where the section of the groove is other than semi-circular, it is also preferable that the corresponding dimension be similar to the values here mentioned.

The meritorious effects of the invention will become more apparent from the following example thereof:

EXAMPLE

Comparison experiments were carried out by using the same coating liquids with different coating heads. The following coating heads were used.

(1) A coating head according to the invention with the section of the groove being semi-circular and with a radius of 5 mm.

(2) A coating head according to U.S. Pat. No. 3,928,678. For the lip-shaped member the horizontal part was 1 mm in length.

(3) The coating head proposed in the Russell et al. patent.

Each coating head was so disposed that it confronted the coating back-up roller with the slide surface tilted downwardly by ten degrees. The coating liquids were a photographing emulsion having a viscosity of 40 cp and a surface tension of 28 dyne/cm and a gelatin solution having a viscosity of 40 cp and a surface tension of 28 dyne/cm. The photographing emulsion and the gelatin solution were coated as the upper layer and the lower layer, respectively.

The experiments were conducted in accordance with the following method. The flow rates of the coating liquids were varied within a range of 10 to 100 cc/cm with the coating liquids first applied at a low coating speed following which the coating speed was gradually increased to determine the maximum coating speed at which the coating liquid could be applied to the web. The results were as follows.

The coating apparatus according to the invention had a maximum coating speed of 139 m/min with a coating liquid flow rate of 10 cc/cm at the minimum. On the other hand, the coating apparatus constructed according to U.S. Pat. No. 3,928,678 and the coating apparatus of the Russell et al. patent had a maximum coating speeds of 45 m/min and 76 m/min, respectively, under the same conditions.

Furthermore, with a coating liquid flow rate of 20 cc/cm at the minimum, the apparatus according to the invention had a maximum coating speed of 227 m/min while the coating apparatus according to U.S. Pat. No. 3,928,678 had a maximum coating speed of 55 m/min and the coating apparatus Russell et al. produced a maximum coating speed of 76 m/min. With a coating liquid flow rate of more than 50 cc/cm minimum, the maximum coating speeds of these apparatus were substantially equal.

As is apparent from the above description, in the slide bead coating apparatus according to the invention, the falling part and the rising part which extends smoothly therefrom are provided at the lower edge of the slide surface so that the layers of coating liquids flowing down the slide surface are applied to the web while being relatively gradually thinned. Accordingly, the coating speed relative to prior art constructions can be remarkably increased especially at low flow rates of the coating liquids.

The invention has been described with reference to the case where a plurality of layers of coating liquids are coated over the web. However, the slide bead coating method according to the invention can be applied to the case where a single layer of coating liquid is applied to the web. A variety of coating liquids, several cp to 200 cp in viscosity can be used with the invention.

What is claimed is:

1. In a slide bead coating apparatus having a coating liquid supply to be applied to a web, the improvement comprising; means for forming a slide surface downstream of said coating liquid supply, a groove positioned between said slide surface and said web having a falling part dropping abruptly downwardly at a lower edge of said slide surface and a rising part extending smoothly upwardly from said falling part, wherein the speed of a layer of coating liquid flowing down said slide surface is increased by said falling part and is smoothly delivered through said rising part extending from said falling part and gradually thinned during passage through said groove to said web to be coated with said layer of coating liquid.

2. The coating apparatus of claim 1 wherein the cross-section of said groove is semicircular.

3. The coating apparatus of claim 2 wherein the radius of said groove is in a range of 3 to 15 mm.

4. The coating apparatus of claim 2 wherein the radius of said groove is in a range of 4 to 12 mm.

5. The coating apparatus of claim 2 wherein the radius of said groove is in a range of 5 to 10 mm.

6. The coating apparatus of claim 1 wherein the cross-section of said groove is a quadratic curve.

* * * * *